United States Patent [19]

Allio et al.

[11] Patent Number: 4,802,665

[45] Date of Patent: Feb. 7, 1989

[54] CONVEYOR DEVICE FOR FLAT OBJECTS

[75] Inventors: Roland Allio, La Roche de Glun; Raymond Chifflet, Grandes les Valence; Phillipe Jeantin, Valence, all of France

[73] Assignee: Compagnie Generale D'Automatisme CGA-HBS, Paris, France

[21] Appl. No.: 78,955

[22] Filed: Jul. 29, 1987

[30] Foreign Application Priority Data

Jul. 29, 1986 [FR] France ..... 86 10970

[51] Int. Cl.[4] ..... B65H 5/00

[52] U.S. Cl. ..... 271/225; 271/184; 271/199; 271/2; 198/407; 198/535

[58] Field of Search ..... 271/184–186, 271/303, 225, 202, 198, 199, 306, 69, 272, 273, 270, 2, 6, 7; 198/457, 407, 409, 535, 413

[56] References Cited

U.S. PATENT DOCUMENTS

| | | | |
|---|---|---|---|
| 3,752,043 | 8/1973 | Rapparlie et al. | 271/202 X |
| 3,885,664 | 5/1975 | Fujimura | 271/184 X |
| 4,146,215 | 3/1979 | Mol | 271/303 X |
| 4,214,740 | 7/1980 | Acquaviva | 271/272 X |
| 4,408,560 | 10/1983 | Caratsch | 271/185 X |
| 4,518,241 | 5/1985 | Huss | 271/184 X |

*Primary Examiner*—Kevin P. Shaver
*Assistant Examiner*—David H. Bollinger
*Attorney, Agent, or Firm*—Sughrue, Mion, Zinn, Macpeak & Seas

[57] ABSTRACT

A belt and pulley conveyor device for flat objects comprises a substantially linear input conveyor and a substantially linear output conveyor orthogonal to the input conveyor. The input of the output conveyor is substantially contiguous with the output of the input conveyor. A chute is adapted to link the input and output conveyors. It has an object input/output and is adapted to pivot between an idle position in which it extends the output of the input conveyor and a transfer position in which it extends the input of the output conveyor. A control device is adapted to move the chute between the idle and transfer positions.

9 Claims, 4 Drawing Sheets

CONVEYOR DEVICE FOR FLAT OBJECTS

BACKGROUND OF THE INVENTION

1. Field of the invention

The present invention concerns belt and roller conveyor devices for flat objects enabling these objects to be processed or operated on as they are being transported.

2. Description of the prior art

These flat objects may be mail packets, for example. A conveyor device of the type indicated above is used to transfer them from an unstacking device, which delivers them one by one, to a plurality of tamper modules in a sorting station which routes and stacks them according to their destination. During this transfer from the unstacking device to the sorter modules a processing station upstream of the sorting station determines the destination of each successive packet.

An organisation of this kind is known as such. The processing station may involve an operator reading addresses and manually controlling the coding of successive packets, optionally with the printing of destination bar codes on the packets, for batches of packets which do not carry any such destination codes. It may serve to read destination codes automatically from packets in batches of packets carrying such codes. It may also involve reading of addresses by the operator and computer-controlled re-addressing of the packets according to input information generated by the operator after reading the address and corresponding re-addressing information stored in memory, optionally with printing of the new address and the bar code of the new destination.

The sorting station may be formed by a series of tamper modules mounted along the conveyor device, each module consisting of a paddle for holding back an evolving stack of packets on a base plane which is advantageously inclined, with an input switching device in the module.

These processing and sorting stations of the conveyor device require the packets to have at each station speeds compatible with the operation or operations that they carry out. For example, the operator reads the address from a packet which is halted at a reading position while destination bar codes are printed on the packets by an ink-jet printer as the packets move at a speed in the order of 0.4 m/s. In the sorting station, on the other hand, correct insertion and tamping of the packets in the tamper modules require that the packets arrive at a high speed, in the order of 3.5 m/s. The conveyor device therefore comprises a variety of individual belt and pulley conveyors each having its own respective speed and together defining a continuous path of movement for the packets.

To save space the conveyor device has a trajectory with curved portions between the processing stations, for folding it back on itself with rectilinear portions retained at the processing stations. In a mail coding and sorting machine the address reading and coding station(s) are placed before the operator, the sort in station is to the side and the trajectory of the conveyor device forms a double-bend transition between them.

In machines for coding and sorting mail and other machines for processing flat objects conveyed along processing stations conveyor devices with a folded trajectory are not always satisfactory. The curved portions of the trajectory must have large radii of curvature, as appropriate to the nature of the objects (for example their stiffness and whether they contain carbon paper), which is detrimental to the objective of a compact implementation. Depending on the processing carried out, any such folding back on itself of the conveyor trajectory, which involves turning round the objects, may be incompatible with or prejudicial to the processing to be carried out at any of the stations. In particular, such turning round of packets may result in jamming at a sorting station on insertion of the packets into the tamper modules by snagging of the packet entering its module on the address window of the top packet of the stack already made up there.

An object of the present invention is to avoid these disadvantages by making it possible to convey objects separately from each other with a high degree of reliability and without risk of damage to said objects, within a compact implementation.

SUMMARY OF THE INVENTION

The present invention consists of a belt and roller conveyor device for flat objects, comprising a substantially linear input conveyor having an object input and an object output, a substantially linear output conveyor orthogonal to said input conveyor and having an input and an output, the input of said output conveyor being substantially contiguous with the output of said input conveyor, a chute that is adapted to link said input and output conveyors, has an object input/ output and is adapted to pivot between an idle position in which it extends the output of said input conveyor and a transfer position in which it extends the input of said output conveyor, and control means adapted to move said chute between said idle and transfer positions.

In accordance with another characteristic of the invention the chute carries a roller at the side which contributes to the guiding of said objects as they are inserted into the chute in the idle position and cooperating with one of the belts of the output conveyor to secure ejection of said objects from the chute in the transfer position.

The characteristics and advantages of the present invention will emerge from the following description of one embodiment thereof given by way of example only and with reference to the appended drawings.

DESCRIPTION OF THE PREFERRED EMBODIMENT

Figure 1:
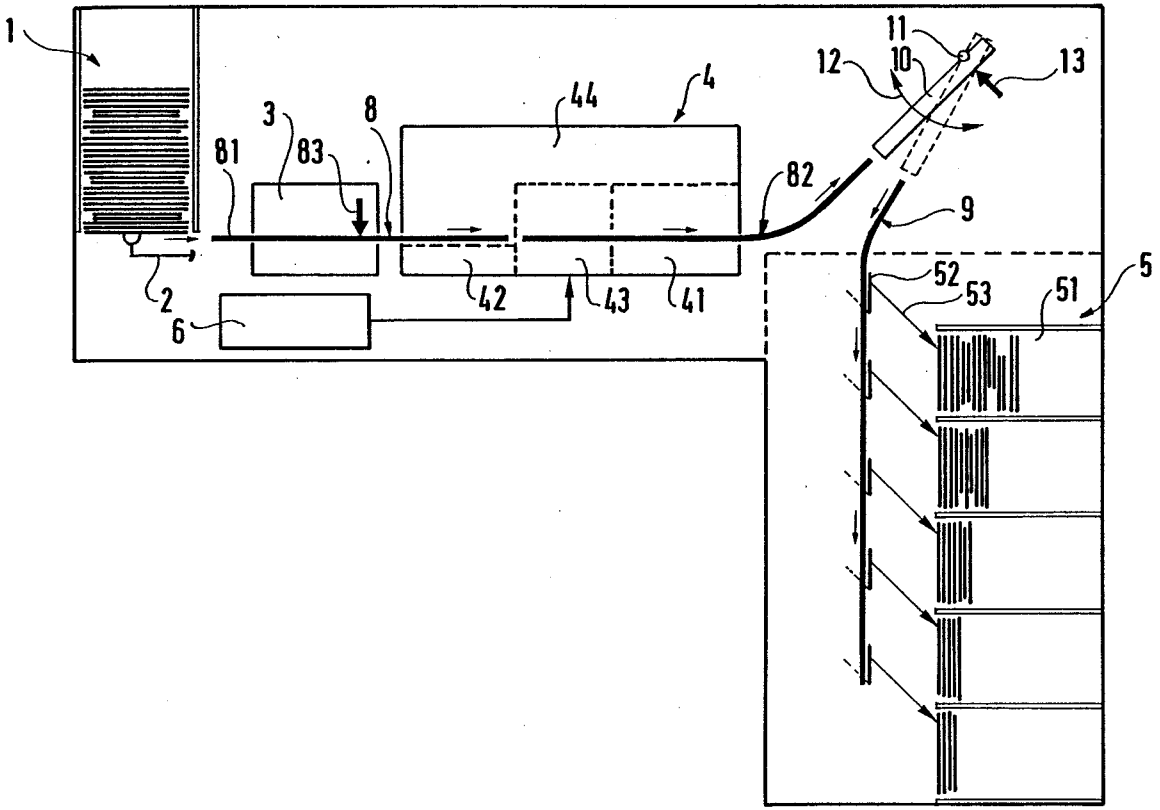
FIG. 1 is a schematic diagram showing the conveyor device in accordance with the invention used in a machine for coding and pre-sorting automatically fed mail packets.

FIG. 1 shows in a highly schematic way a machine for coding and pre-sorting mail packets which utilizes the conveyor device in accordance with the invention.

This machine is fed automatically. The packets to sort are initially placed in a stack in a feed hopper 1 at the end of which is an unstacker head 2. The packets dispensed one by one by the unstacker head are taken off rapidly and passed through an address reading station 3 and a coding station 4. They are then routed through a pre-sorting station 5.

At the address reading station 3 each packet is stopped for an operator to read the address that it carries.

At the coding station the successive packets receive a bar code according to their destination, which has just been read. For this purpose the operator uses a keyboard 6 to enter the destination information he has read into an ink-jet printer 41 which forms part of the coding station 4 and prints the corresponding bar code onto the packet concerned.

The coding station 4 can also process packets to be re-addressed. In this case, as shown, it comprises a label printer unit 42 receiving the new address followed by a unit for applying the label 43 to the packet concerned before the bar code is printed, and a control unit 44. The new address is determined within the control unit 44 in response to the corresponding read information, which is transmitted to it from the keyboard 6, and readdressing information stored locally or remotely; the new address is then supplied to the bar code printer 41.

In the pre-sorting station 5, the successive packets are directed to one of the tamper modules 51 that it comprises, as appropriate to their destination; each tamper module constitutes a stacking magazine the capacity of which changes as mail is received and is associated with an input switching device 52 controlled from the coding station and with means for inserting deviated packets schematically represented at 53.

To save space the pre-sorting station is mounted transversely to the combination formed by the magazine and its unstacking head, the address reading station and the coding station.

A conveyor device in accordance with the invention conveys packets through this series of stations.

A so-called input conveyor 8 is assigned to conveying packets from the unstacker head through the address reading and coding stations. A so-called output conveyor 9 is assigned to conveying packets through the sorting station, the switching devices at the input of the various tamper modules deflecting packets from this output conveyor or not, as necessary.

The input conveyor 8 and the output conveyor 9 are of the type comprising driving and friction belts and pulleys. They have drive speeds compatible with the operations conducted in the stations through which they pass. Thus the input conveyor 8 is formed by a plurality of individual conveyors 81, 82 in series, along a substantially linear trajectory. The individual conveyor 81 has a relatively high speed, in the order of 1.5 m/s, in order to detach the packets that it receives from the unstacking head. It passes through the address reading station where it is associated with a retractable barrier 83, the opening period for which is defined by the unstacking head, for momentarily stopping the packets in the address reading position. The individual conveyor 82 passes through the label application and bar code printing stations of the coding station. It has a low speed, in the order of 0.4 m/s, for these operations. The output conveyor 9 also has a substantially linear trajectory; it has a relatively high speed, in the order of 3.5 m/s, so as to impart to the various packets sufficient force to insert them into the corresponding tamper modules.

The output of the input conveyor 8 and the input of the output conveyor 9 are substantially contiguous and the packet conveyor device comprises, in addition to these conveyors 8 and 9, a pivoting chute 10 linking them. This chute is placed substantially in alignment with the output from the input conveyor 8 to receive each packet and is aligned with the input of the output conveyor to transfer to it each packet that it receives.

The chute 10 is slightly longer than the longest packets it is to accommodate. It is supported on a fixed spindle 11 about which it pivots as shown by the double-headed arrow 12, between an idle position and a transfer position in which it is shown in full line and dashed line, respectively. Control means schematically represented at 13 place it in one or other of these two positions.

The output of the input conveyor 8 and the input of the output conveyor 9 advantageously feature a curve having a large radius of curvature enabling slight angular movement of the chute for extending them alternately without deformation of the packets as they enter the chute and leave the chute.

Figure 2:
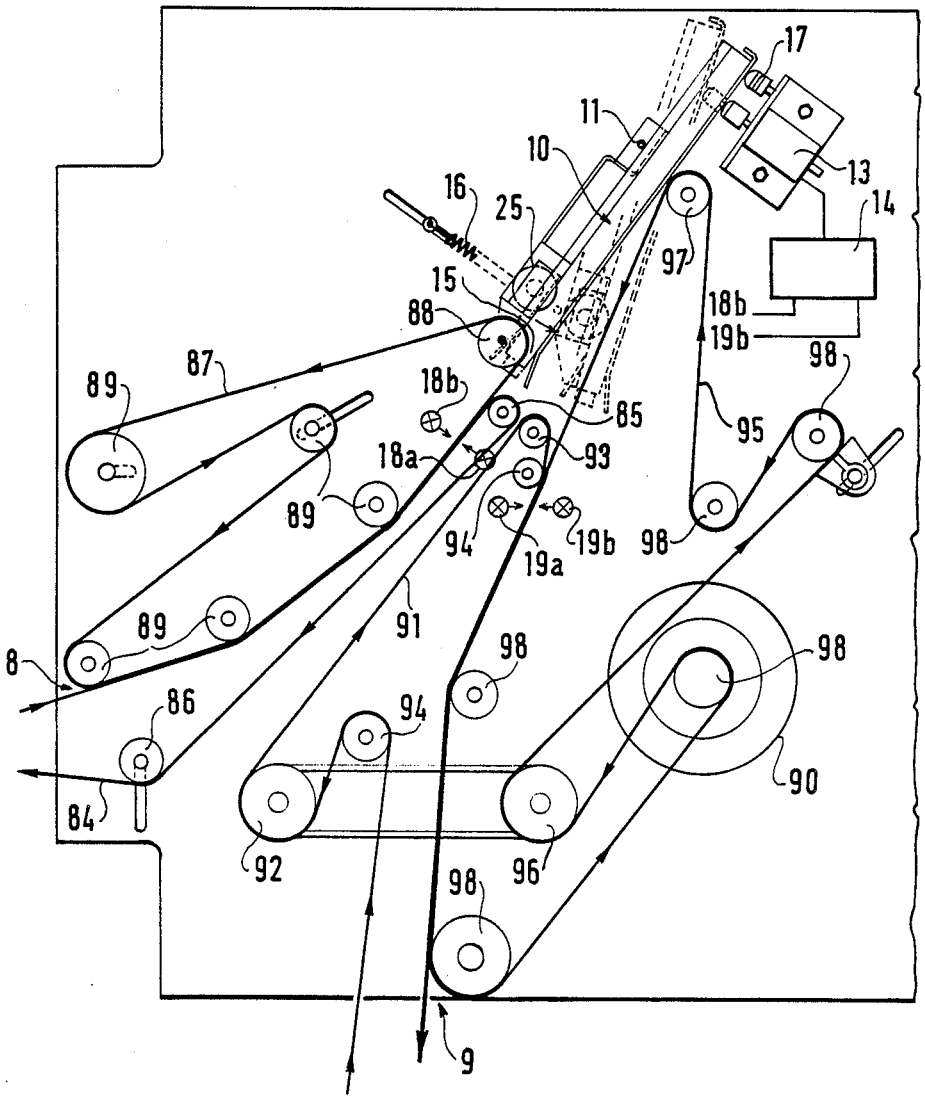
FIG. 2 is a partial view of the conveyor device in accordance with the invention corresponding to the transition area of the device in FIG. 1.

FIG. 2 shows to a larger scale and in a more complete way the part of the conveyor device including the chute 10 linking the output of the input conveyor 8 and the input of the output conveyor 9.

The input conveyor 8 comprises a drive belt 84 on an end direction-changing pulley 85 and a tension pulley 86 and an end friction belt 87 mounted on an end direction-changing pulley 88 and on guide and tension pulleys 89. These belts defined between their runs pressing against each other, as shown in bold line, the slightly arcuate output path of the input conveyor 8 discharging substantially opposite and at a small distance from the input/output 15 of the chute 10 when in the idle position.

The friction belt 87 is inserted part way into the input/output 15 of the chute 10 when in its idle position; as each packet is inserted into the chute it entrains and guides it.

FIG. 2 shows, for the output conveyor 9, a drive belt 91 mounted on a pulley 92, an end direction-changing pulley 93 and guide pulleys 94 and an end friction belt 95 which also serves as a drive belt. The end friction belt 95 is mounted on a pulley 96, an end direction-changing pulley 97 and guide or tension pulleys 98. The driving pulley for the belt 91 is not shown; it is in the pre-sort module. The pulley 96 is coupled to the pulley 92 in order to drive the belt 95 at the same speed as the belt 91.

One of the direction-changing pulleys 98 carries an encoder wheel 90 providing an indication of the speed at which the packets are being driven on the output conveyor 9. This information is used in controlling the pre-sort station (FIG. 1).

The parts of the two belts 91 and 95 pressing against each other, as shown in bold outline, define the slightly arcuate input path of the output conveyor 9, facing and at a short distance from which is the input/output 15 of the chute 10 when in its transfer position. The friction belt 95 is inserted into the chute when in the transfer position over a major part of its length. It entrains from out of the chute the packet which is there and guides it so as to transfer it into the output conveyor 9; this belt is referred to hereinafter as the ejector belt.

FIG. 2 also shows the spindle 11 about which the chute 10 pivots and the control means 13. These consist of an electromagnet operating on the terminal part of the chute opposite its inlet/outlet, for placing and holding the chute in its transfer position. The electromagnet 13 is controlled (energized or de-energized) from a logic circuit 14. A return spring 16 opposing the action of the electromagnet on the chute places the chute in its idle position and holds it there when the electromagnet is not energized. An abutment member 17 cooperates with the spring 16 to position the chute correctly in its idle position.

In FIG. 2 the spring 16 is mounted beside the chute input/output so as to have it appear more clearly. It may instead be situated beside the electromagnet and so lie outside any possible packet trajectory. As an alternative to this, the abutment member 17 could be replaced with a rubber ring on the axis of the electromagnet.

At the output from the input conveyor 8 a lamp **18*a* and an associated photo-electric cell 18*b* detect the successive packets. At the input of the output conveyor 9 another lamp 19*a* and another, associated photo-electric cell 19*b* detect packets at their level. These cells 18*b* and 19*b* control the electromagnet 13 through the logic circuit 14: the cell 18*b* energizes it at the end of detection of each packet, after a few milliseconds time-delay to enable the packet to enter the chute entirely, the cell 19*b*** de-energizing the electromagnet when it detects each packet.

Figure 3:
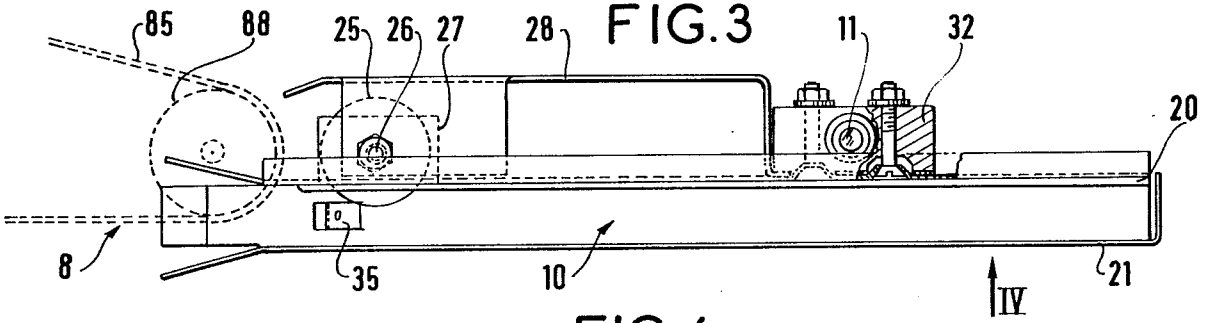
FIG. 3 is a plan view of the transition member forming part of the conveyor device.
Figure 4:
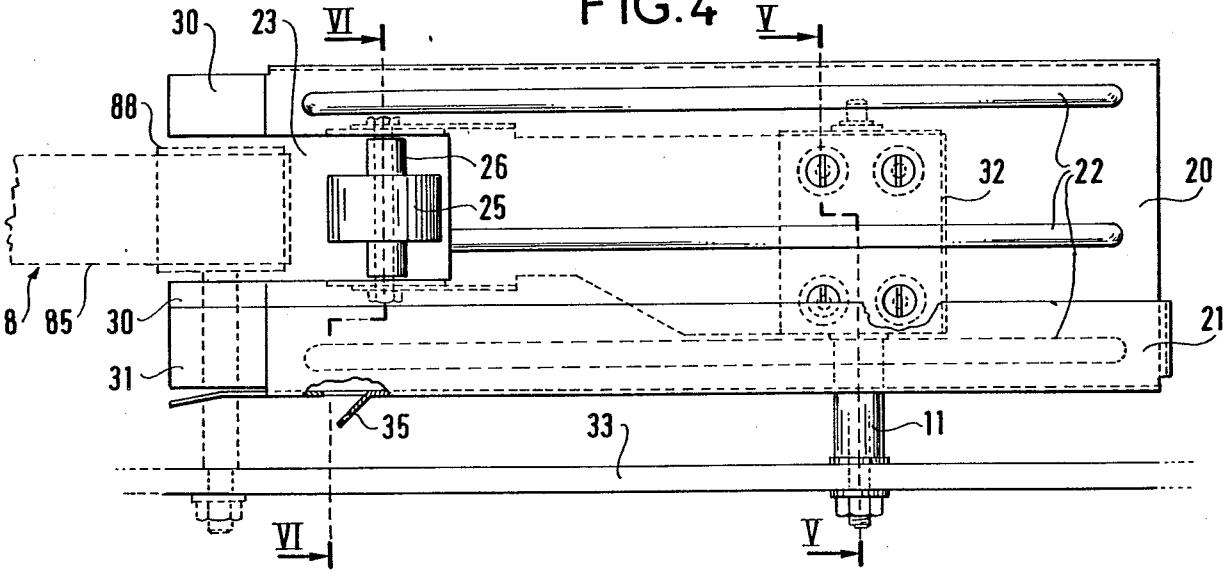
FIG. 4 is a front view of the transition member, as seen in the direction of the arrow IV in FIG. 3.
Figure 5:
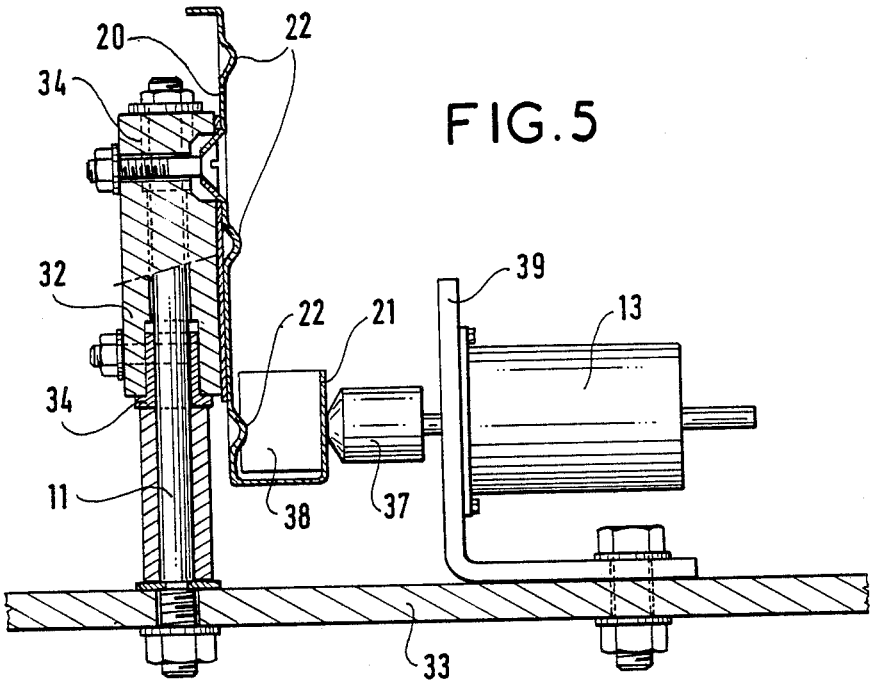
FIGS. 5 and 6 are two views in cross-section through the transition member, respectively on the lines V—V and VI—VI in FIG. 4.
Figure 6:
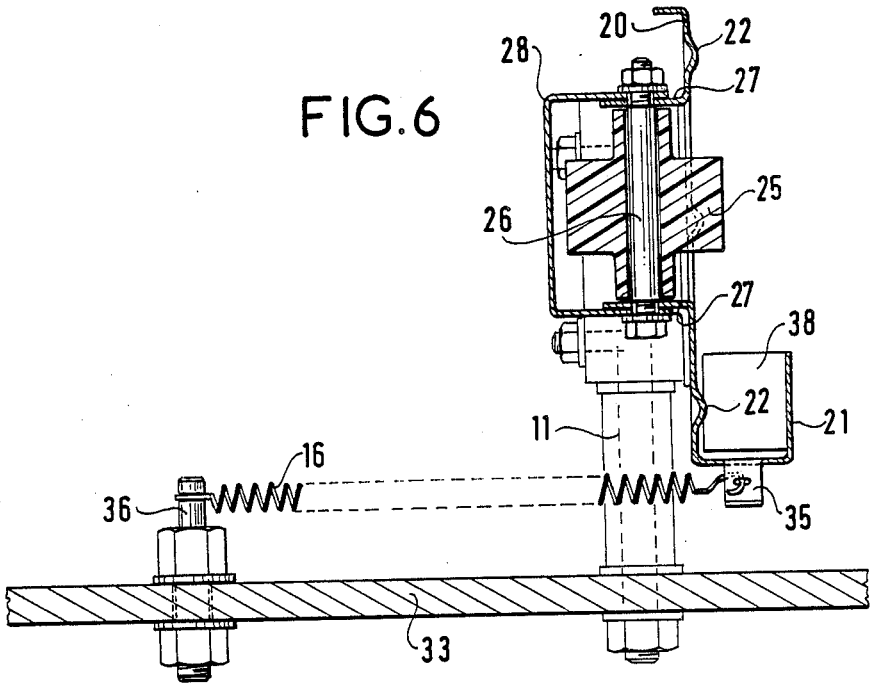

A more precise description of the chute 10 is given with particular reference to the two plan and front views of the chute given in FIGS. 3 and 4 and/or the two views in cross-section of FIGS. 5 and 6.

The chute 10 has a U-shape profile; one of its vertical sides 20 has a height similar to that of the largest packets and is referred to hereinafter as the high side of the chute. The other side 21 is low and is referred to hereinafter as the low side. Turning to FIG. 2, the belt 87 of the input conveyor 8 cooperates with the high side of the chute to partially insert its end direction-changing pulley 88A into the input/output of the chute when in the idle position; the ejector belt 95 of the output conveyor 9 cooperates with the low side, the level of which is below that of this belt, to permit it to pass under this belt when the chute pivots towards the transfer position, and so permit partial insertion of the belt 95 into the path of the chute in the transfer position.

The high side 20 has a set of ribs 22 on its inside surface, stiffening it and reducing friction on the packets. On the side of the input/output 15 of the chute it features a cut-out window 23 open at the end into which the end direction-changing pulley 88 carrying the belt 85 of the input conveyor 8 is partially inserted when the chute is in the idle position. In the innermost part of this same window 23 there is a roller 25. The roller 25 is an idler roller and is carried by vertical shaft 26 mounted between two horizontal lugs 27 on the outside surface of the high wall 20 of the chute, obtained when the window 23 is formed. Its periphery also projects from the inside surface of this high side; the packets from the input conveyor 8 arrive substantially tangential to the roller 25 when the chute is in the idle position. This roller is pressed against the ejector belt 95 when the chute is in the transfer position; it is mounted at substantially mid-height on the high side 20, at the level of the ejector belt 95 of the output conveyor 9.

A deflector flap 28 is attached to the outside of the high side 20 of the chute, extending along the chute substantially from its input/output 15, where its end is bent slightly towards the high side, at least as far as its median part in line with the spindle 11. This deflector flap also forms a protective cover for the roller 25. When the chute 10 is in the transfer position the flap 28 is in front of the pulley 88; it guides ejection of any packets that may then be fed from the input conveyor 8, preventing any jamming occurring when the chute returns to the idle position.

The input/output 15 of the chute 10 is flared in a V-shape. To this end its sides 20 and 21 have their end portions 30 and 31 folded and slightly bent back towards the outside.

Beyond the deflector flap 28 a support block 32 is fixed to the high side 20 of the chute. The vertical spindle 11 fixed to a crossmember 33 on the main frame under the chute and carrying the spindles of the conveyor pulleys passes through the block 32. The latter is free to rotate on the spindle 11 through the intermediary of bearings 44. This block extends substantially two-thirds of the length of the chute, from its input/output 15.

On the bottom of the chute, substantially level with the input/output 15, a lug 35 formed by stamping the chute bottom is used to attach one end of the spring 16 which returns the chute to its idle position. The other end of this spring is attached to a pin 36 carried by the frame crossmember 33.

Nothing is attached to the low side 21 anywhere along its length. Only the electromagnet 13 has its plunger which forms a retractable abutment member 37 against this low side, substantially level with its end opposite the input/output 15 of the chute. At this end opposite the input/output of the chute a lug 38 formed by bending the side 20 is bent across to close off the path inside the chute.

A bracket 39 fixed to the frame crossmember 33 carries the electromagnet 13. To this same bracket 39 is also fixed the abutment member 17 (FIG. 2) serving as a buffer when the chute returns to the idle position when the electromagnet is de-energized.

The conveyor device in accordance with the invention functions as follows:

the successive packets delivered by the unstacking head are taken up by the input conveyor 8;

each packet passes through and, where necessary, stops at the processing stations mounted along the input conveyor and is conveyed to the output from the conveyor at the speed or speeds conferred on it by the conveyor;

at the output from the input conveyor 8 each packet is sensed by the detector **18*b*;**

when the trailing edge of the sensed packet leaves the detector **18*b* a time-delay of a few milliseconds is initiated to enable the packet concerned to enter the chute 10 in its idle position, the belt 85** having entrained it until the trailing edge of the packet escapes from it;

the electromagnet 13 is energized immediately the time-delay has elapsed and pivots the chute into the transfer position; during this movement to the transfer position the low side of the chute passes under the belt 95 of the output conveyor 9 and the roller 25 pressed against the belt 95 clamps the packet in the chute against this belt;

when the chute reaches its transfer position the roller 25 forms a counter-roller associated with the ejector belt 95 so as to eject the packet from the chute, to be taken up by the belts 91 and 95; for this to occur correctly, without rebound, the distance between the point at which the packet is gripped between the two belts 91 and 95 at the input to the conveyor 9 and the roller 25 enables the belt 95 to accommodate bending compatible with the maximum possible thickness of the packets, with the electromagnet still holding the chute in the transfer position;

the electromagnet is de-energized when the detector **19*b* senses the rear edge of the packet taken up by the conveyor 9**;

the return spring 16 returns the chute to the idle position, any rebound being avoided by the abutment member 17, so that the chute is ready to receive the next packet output by the conveyor 18 in order to transfer it;

the successive packets on the output conveyor 9 are entrained at the high speed conferred on them by this conveyor; during this entrainment they are directed to and placed in the tamper modules corresponding to their respective destinations, on the basis of commands received from the coding station.

During this functioning any packets which overlap at the output from the input conveyor 9 are seen as a single packet by the detector **18*b*; they are treated as such by the chute which transfers them onto the output conveyor 9. Any packets that may be delivered by the input conveyor 8 while the chute is in the transfer position are ejected out of the conveyor path by the deflector flap 28**.

The logic circuit 14 connected to the detectors **18*b* and 19*b* also makes it possible to minimize any possible jamming problems at the chute due to insufficient spacing between packets at the output from the input conveyor. A jam occurs if two packets appear at the output of the input conveyor 8** separated from one another but, in a first case, with a very small gap between them and, in a second case, not quite sufficiently spaced from each other.

In the first of these two cases the processing circuit inhibits the command to energize the electromagnet at the end of the time-delay which started on detection of the trailing edge of the first of the two packets, so that the second packet and the first are considered as two overlapping packets, whereupon the second packet is processed with the first in the chute. The masking of the detector **18*b*** as soon as the leading edge of the second packet passes over it when the time-delay initiated at the trailing edge of the first packet has been started but has not finished renders the end of this time-delay inoperative in order not to energize the electromagnet to prevent the second packet beginning to enter the chute as it begins to pivot towards its transfer position.

In the second of the two cases the processing circuit 14 inhibits the de-energizing of the electromagnet causing it to return to its idle position so that the second of the packets in question is ejected from the conveyor path. Masking of the detector **18*b* by the second packet with the detector 19*b* still masked by the first packet being transferred along the output conveyor inhibits de-energization commanded on the detector 19*b* detecting the trailing edge of the first packet for the period for which the detector 18*b*** is masked followed by the associated time-delay, so that the second packet is considered to have been ejected.

Thus, assuming a normal spacing between packets in the order of 100 mm:

packets separated by a distance of 100 mm or more are transferred from the conveyor 8 to the conveyor 9 by the chute, overlapping packets are processed as a single packet, two packets separated by 3 mm or less are processed as two overlapping packets and thus as a single packet, two packets separated by between 3 and 100 mm are transferred normally in the case of the first packet and ejected from the conveyor path in the case of the second packet.

This conveyor device has numerous advantages, in particular:

it results in a minimal path length without curved transitions between the individual conveyors that it comprises, which could damage the packets, and thus has minimal overall dimensions, it avoids turning round the packets conveyed, which can also be prejudicial to the processing conducted along the output conveyor, it provides for linking up the individual conveyors that it comprises which have very different speeds, it is fast and reliable by virtue of its simplicity, the low inertia and the low angular travel of the chute, the roller 25 which carries the chute guiding the incoming packet and with one of the output conveyor belts entraining the packet in the chute in order to release this packet.

For conveying mail into a coding and presorting machine it should be noted that the device is particularly well adapted to handling a wide spectrum of mail items, with maximum dimensions in the order of 292 mm long, 156 mm high and 6.35 mm thick and minimum dimensions in the order of 127 mm long, 89 mm high and 0.17 mm thick and a weight between 85 and 2.8 grams.

The present invention has been described with reference to the embodiment thereof shown. It is to be understood that modifications of detail may be applied to it and/or certain devices or parts replaced by other equivalent devices or parts without departing from the scope of the invention.

We claim:

1. A conveyor device for flat objects, comprising a substantially linear input conveyor having an object input and an object output, a substantially linear output conveyor orthogonal to said input conveyor and having an input and an output, the input of said output conveyor being substantially contiguous with the output of said input conveyor, a U-shaped chute, pivotably mounted on said conveyor device, for linking said input and output conveyors, said chute having an object input/output end and being pivotable between an idle position in which it extends the output of said input conveyor and a transfer position in which it extends the input of said output conveyor, said chute further including a roller partially projecting thereinto from one side thereof, said roller being substantially aligned with the output of said input conveyor when said chute is in said idle position and substantially aligned with the input of said output conveyor when said chute is in said transfer position, said chute also having a high side from which said roller projects and a low side below a level of said output conveyor, said output conveyor including an ejector belt extending beyond the input of said output conveyor and partly into said chute when in said transfer position, in which said roller is pressed against said ejector belt, said conveyor device further comprising control means for moving said chute between said idle and transfer positions.

2. Conveyor device according to claim 1, wherein said high side of said chute comprises a window at the input/output end of said chute, said input conveyor having one belt which is inserted partially into said window when said chute is in said idle position, said roller being disposed inside said window.

3. Conveyor device according to claim 1, wherein said high side of said chute comprises a deflector flap on its outside substantially at the end of the output from said input conveyor when said chute is in said transfer position.

4. Conveyor device according to claim 1, wherein said high side of said chute comprises a support attached to its outside closer to an end opposite the input-/output end of said chute than to said input/output end, said support rotating freely about a fixed spindle defining a pivot axis of said chute.

5. Conveyor device according to claim 4, wherein said control means comprise a retractable abutment member having a retracted position and a non-retracted position and bearing externally against said low side of said chute substantially at the end thereof opposite said input/output end thereof, return means opposing an action of said retractable abutment member fixed to said chute and a first detector for sensing said objects at the output from said input conveyor, said control means responding to said sensing of said objects at the output from said input conveyor by placing said retractable abutment member in the non-retracted position.

6. Conveyor device according to claim 5, further comprising a second detector for sensing said objects at the input of said output conveyor and wherein said control means respond to said sensing of said objects at the input of said output conveyor by placing said non-retractable abutment member in the retracted position.

7. Conveyor device according to claim 6, further comprising a logic circuit coupled to said first and second detectors and adapted to delay actuation of said retractable abutment member to prevent transfer of an object from said input conveyor to said chute while said chute is moving from its idle position to its transfer position or vice-versa.

8. Conveyor device according to claim 5, further comprising a buffer abutment member associated with said return means and mounted with said retractable abutment member in front of said low side of said chute.

9. Conveyor device according to claim 1, wherein said input and output conveyors together comprise a plurality of individual conveyor belts having respective different speeds and passing through successive operator stations and wherein said output conveyor has a speed higher than that of the upstream input conveyor to which it is linked by said chute.

* * * * *